US007962995B2

(12) United States Patent
Allaway

(10) Patent No.: US 7,962,995 B2
(45) Date of Patent: Jun. 21, 2011

(54) APPARATUS FOR CLEANING SYNTHETIC GRASS

(75) Inventor: Allan William Allaway, Graceville (AU)

(73) Assignee: Allan William Allaway, Graceville, QLD (AU)

( * ) Notice: Subject to any disclaimer, the term of this patent is extended or adjusted under 35 U.S.C. 154(b) by 1021 days.

(21) Appl. No.: 11/794,657

(22) PCT Filed: Jun. 3, 2005

(86) PCT No.: PCT/AU2005/000799

§ 371 (c)(1),
(2), (4) Date: Jul. 3, 2007

(87) PCT Pub. No.: WO2005/118959

PCT Pub. Date: Dec. 15, 2005

(65) Prior Publication Data

US 2009/0205157 A1 Aug. 20, 2009

(30) Foreign Application Priority Data

Jun. 3, 2004 (AU) ..... 2004202438

(51) Int. Cl.
*E01H 1/08* (2006.01)
*A47L 5/14* (2006.01)

(52) U.S. Cl. ..... 15/345; 15/340.1

(58) Field of Classification Search ..... 15/340.1, 15/345, 346, 405; *A47L 5/14; E01H 1/08*
See application file for complete search history.

(56) References Cited

FOREIGN PATENT DOCUMENTS

| | | |
|---|---|---|
| BE | 890518 | 1/1982 |
| DE | 3824710 | 1/1990 |
| SU | 652261 | 3/1979 |
| WO | WO 91/20272 | 11/1992 |

*Primary Examiner* — David A Redding
(74) *Attorney, Agent, or Firm* — Stein McEwen, LLP

(57) ABSTRACT

An apparatus for cleaning a synthetic grass surface, the apparatus comprising a plenum head and a manifold, the plenum head disposed within the manifold and having a compressed air inlet and at least one air outlet through which air can be expelled against the synthetic grass surface for dislodgement of coarse and fine particulate material and to entrain the dislodged particulate material into the manifold which extends above the plenum head, said manifold including an outlet located in an upper region of the manifold for expelling the fine particulate material, and an outlet in a lower region of the manifold for distributing the coarse particulate material back to the synthetic grass surface, wherein the plenum head is mounted for rotation within the manifold about a substantially vertical axis.

12 Claims, 2 Drawing Sheets

APPARATUS FOR CLEANING SYNTHETIC GRASS

FIELD OF THE INVENTION

The present invention relates to an apparatus which can be used for cleaning a surface such as a synthetic grass surface as may be used as a tennis court, hockey field or other recreational surfaces. Such surfaces are generally subject to weathering and the accumulation of dust, moulds and mildew.

BACKGROUND ART

Synthetic grass surfaces typically comprise a synthetic surface from which extends tufts of simulated grass fibres of a plastic material. Sand is laid on the surface filling the spaces between the tufts so that the tufts remain substantially erect and produce a flat surface which provides a surface suitable for use as a recreational surface.

Typically synthetic grass is very durable. Sand normally collects at the bottom of the synthetic grass and grime, mould and mildew collects on external fibres of the synthetic grass leading to premature degradation and a reduction in performance.

Because the synthetic grass is porous whenever rain falls, dust and contaminants rise to the surface of the synthetic grass fibres leading to a degradation in surface quality and consequential problems for the sporting activity for which the synthetic grass is being used.

Sweeping a synthetic grass surface with a brush is normally ineffective because not all particulate material is moved and when it is moved, it tends to disperse in all directions. Brushing is generally ineffective in breaking up aggregated particulate matter and can in fact damage the fibres of the synthetic grass surface. Brushing does not remove dust and other contaminants, it merely redistributes these contaminants which are believed to be the main cause of aggregation of sand particles, the consequential compaction of fibres and the growth of algae and moss.

Moreover, to attempt to clean an entire tennis court using such a method in conjunction with a washing detergent would be extremely time consuming. Accordingly, there is a need for an apparatus which can effectively remove particulate material as well as organic material such as mould and mildew from deep within the synthetic grass.

In the past, cleaning a synthetic grass surface has been performed with high-pressure water. Cleaning in this manner is a very untidy process and usually requires the replacement of much of the sand and also a considerable amount of relevelling. Relevelling is difficult with wet sand and is a particularly laborious, time-consuming process.

Machines for cleaning synthetic grass surfaces are also known. The machines generally pass over the surface and have a front head attachment which blows high-pressure air against the ground surface to be cleaned. The head attachment has a shroud in which a plenum chamber is located and through which plenum chamber the high-pressure air passes against the ground surface. The pressurized air was dispersed onto the synthetic grass surface using a perforated drum which expelled air at a fixed angle onto the synthetic grass surface as the machine passed over the surface. The high-pressure air breaks up any dirt, debris, moss, caked sand, dust, and the like, and some separation of dust and sand is achieved by virtue of a powerful vacuum arrangement in the head attachment. The cleaned sand passes through the baffles and back onto the playing surface, while the dust, dirt, and the like passes through an outlet and into collection bags. Because the head attachment is not very efficient in separating dust from sand, much sand also passes into the collection bags and therefore the collection bags are arranged upwardly with a lower inlet such that the heavier sand passes back through the inlet and into a sand collecting chamber. An example of this apparatus is described in my earlier Australian patent no. 647607.

While this apparatus was satisfactory for some users, it was found that too much sand was being removed from the playing surface. The upward vertical collection bags were also quite dangerous as they were fully exposed and tended to flap in the wind. The apparatus was also not suitable for any cleaning other than separating dust from sand, and thus the apparatus was more or less limited to tennis courts.

I then developed an improved model of this apparatus in which a baffle was located within a shroud of the head attachment and above the plenum chamber, the baffle having a first leading portion joined to an inner wall of a leading portion of the shroud, and also having a trailing portion spaced inwardly from the trailing portion of the shroud. Accordingly, the baffle formed a torturous pathway for dust thrown up by the compressed air to pass through the outlet. This arrangement considerably improved the separation of dust and sand meaning that a minimum amount of sand passed through the outlet into the collection bags.

Again, while the cleaning achieved this apparatus performed was satisfactory, it was still found that too much sand was being removed from the playing surface. The machine also tended to flatten the synthetic grass fibres or force them to adopt a prone condition. This reduces the effectiveness of the cleaning performed and also the quality of the synthetic grass surface after cleaning.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to an apparatus for cleaning synthetic grass, which may at least partially overcome at least one of the abovementioned disadvantages or provide the consumer with a useful or commercial choice.

In one form, the invention resides in an apparatus for cleaning a synthetic grass surface, the apparatus comprising a plenum head and a manifold, the plenum head disposed within the manifold and having a compressed air inlet and at least one air outlet through which air can be expelled against the synthetic grass surface for dislodgement of coarse and fine particulate material and to entrain the dislodged particulate material into the manifold, said manifold extending above said plenum head, said manifold including an outlet located in an upper region of the manifold for expelling the fine particulate material, and an outlet in a lower region of the manifold for distributing the coarse particulate material back to the synthetic grass surface, wherein the plenum head is mounted for rotation within the manifold about a substantially vertical axis.

The apparatus is suitably arranged on a framework which permits easy manipulation over the surface to be cleaned. An arrangement for removing the separated lightweight matter and collecting it may also be included on such a framework. Most preferably, the framework is wheeled so that the device may be pushed or driven over the surface to be cleaned.

The plenum head is preferably an elongate arm member, most suitably oriented substantially horizontally. The length of the plenum arm member preferably extends from one side of the manifold to the other, that is, when the rotating head is oriented widthwise, it is arranged such that it extends at approximately right angles to the direction in which the device is adapted to move or be propelled over the ground surface. The plenum head may be mounted centrally in relation to the manifold by any suitable means. The compressed air supply may be fed to the rotating plenum member using any configurations which allows the uninhibited rotation of the plenum head.

The plenum head has at least one compressed air inlet mounted approximately centrally along its length, and at least one outlet of relatively reduced size which effects an increase in the velocity of the air passing therethrough. The plenum arm member may suitably be mounted for rotation about a substantially central point along its length also in order to increase the efficiency of the apparatus and to decrease vibration and the like.

The egress of air through the outlets may provide rotation of the plenum head or the plenum head may be driven using other means such as a mechanical, electrical, pneumatic or hydraulic drive.

Preferably, the at least one outlet directs the air at an angle downwardly beneath the apparatus against the particulate matter to be dislodged from the synthetic grass surface and entrained in the air flow. The outlet may be one or more narrow slits, nozzles or orifaces. There may suitably be a plurality of outlets preferably extending substantially linearly along an arm of the rotating assembly or, most preferably, a multiplicity of aligned pin holes or nozzles. Preferably, the nozzles or the like are disposed symmetrically about the axis of rotation of the plenum head. Of course, other configurations of the outlets are anticipated and the particular configuration may be chosen according to the condition of the synthetic surface or the degree of cleaning required. In one form, the plenum head may be in the form of an arm extending across the width of the manifold and mounted on a central axis of rotation. Such a configuration may be considered to be two arms extending from the axis of rotation and disposed at an orientation of 180° relative to each other. In other forms, the plenum head may comprise more than two arms radiating from the axis of rotation. Preferably, the arms are equispaced to provide a balanced plenum head. The apparatus may be provided with a number of interchangeable plenum arm members, each having a different configuration of outlets, each arm member and configuration designed to provide different aspects of cleaning to the surface.

Suitably, the internal bore of each outlet is configured so that a venturi effect is produced by the air passing therethrough. The angle at which the outlet(s) is arranged is such as to provide maximum leverage on the particulate matter to be dislodged, whilst simultaneously directing the dislodged matter towards the port of the adjacent manifold. A suitable angle may be between 30° and 75°, most preferably about 60° with respect to the synthetic surface. The number of outlets in the plenum chamber will ideally be maximized so that a large number of individual jets of fast moving air can be directed against the particulate surface, thereby optimising the dislodgment forces thereon. This is particularly important when the particulate matter has formed a hard crusty surface as is quite common in tennis court surfaces. As the rotating plenum arm member having the outlets extending along the length of the arm rotates and the apparatus is moved laterally over the surface to be cleaned, the cleaning provided may be more effective due to a variation in the angle of the air striking the surface. Other configurations are envisaged, for example the arm members of the plenum head may rotate about their tubular axis in addition to the plenum head rotating about the substantially vertical axis. In this manner, a brushing effect may be realised and this could assist in the reconditioning of the synthetic surface on the return of the course particles by forcing the individual fibres to be upstanding.

The outlets may be positioned at a particular height above the surface in order to provide the cleaning effect. This height may typically be approximately 5 mm but the height may be variable by adjusting the separation of the rotating plenum arm member and the surface. Height adjustment means may be provided for this purpose.

The manifold is preferably a circular duct, most suitably of substantially cylindrical configuration having the axial dimension oriented substantially vertically and the radial dimension oriented substantially horizontally. The diameter of the manifold preferably traverses the device from one side to the other, that is, when the rotating plenum arm member is oriented widthwise, it is arranged such that it extends at approximately right angles to the direction in which the device is adapted to move or be propelled over the ground surface. The plenum arm member is suitably arranged centrally within the manifold so as to be closely spaced from the walls of the manifold. The rotation of the plenum arm member within the manifold may not be inhibited by the walls of the manifold.

In one form of the present invention, one or more baffle plates, preferably two baffle plates, may be arranged to partially enshroud the plenum arm member to prevent the coarse particulate matter from being carried into the manifold port and to direct the coarse particulate matter back onto the playing surface from which it has previously been uplifted. The baffle plates may take the form of curved plates arranged at spaced intervals above the plenum arm member.

In order to assist the circulation of the coarse and fine particulate matter in the manifold, a deflector can suitably be located in the region of the particulate inlet. The deflector may be a planar plate which is angled with respect to the adjacent playing surface so that particulate matter striking its surface is reflected upwardly into the manifold.

The manifold is suitably circular when viewed in plan and has a step or shoulder when viewed in elevation. The manifold suitably has a lower sidewall extending upwards away from the ground surface, an intermediate shoulder portion extending substantially perpendicularly from the lower sidewall and an upper sidewall associated with a port for the directed removal of the debris. The upper and lower sidewalls may be substantially cylindrical and the shoulder portion may ideally be a planar annular portion linking the two sidewalls. A lower opening may be defined by the lower sidewall.

It is particularly preferred that the outlets on the rotating plenum head are located towards the respective ends of the plenum head. In particular, there may be a group of outlets at the distal end of one arm of the plenum head and a second group of outlets at the distal end of a second arm of the plenum head. Preferably, each group of outlets may extend no further inwardly towards the centre of the plenum member than the inner end of the shoulder portion. In this manner, the dirt, debris and other detritus, being lighter than the sand of the surface may be separated from the sand by the shoulder portion. In particular, the sand which is heavier may be projected upwards and having a larger momentum may continue on their initial path. As the outlets are located substantially below the shoulder portion, the sand will be projected upwards and strike the shoulder portion, whereupon they may fall back to the ground surface. The dirt and debris particles being smaller and lighter, have a correspondingly smaller momentum and may be carried along with the exhausted air which is removed from the manifold through the port without being impeded by the shoulder portion.

The plenum head, the arms thereof and/or the nozzles may have a protective coating similar applied thereto to reduce the abrasion, attrition or scarifying effect from sand or other detritus which may be forcibly ejected from the surface being cleaned. A particularly preferred coating may have a rubber-like finish.

The lower opening can, if need be, be covered with a grill or mesh of sufficient aperture to prevent entrainment of large pieces of debris which could conceivably block the manifold or at least impede the operation thereof.

The upper region of the manifold generally incorporates the port through which the lightweight matter is exhausted. The port may be simply an opening about which a deflector or similar means can be arranged if necessary to prevent the coarse, particulate matter being sucked therethrough. The coarse particulate matter may then be directed back towards the lower opening of the manifold and be redistributed on the playing surface.

In order to assist in the prevention of the coarse particulate matter blowing out from the sides of the apparatus, between the bottom edge of the manifold and the ground surface, a skirt may be provided. This may take the form of a flat metal plate which extends outwardly from the manifold about its entire perimeter.

As previously mentioned, the apparatus is preferably supported on a wheeled framework. Such a framework is preferably of tubular construction with thin gauge sheet metal walls for minimising the weight of the entire apparatus. A push/pull handle bar is suitably provided at waist-height for easy manipulation, and means enabling the manifold to be lowered close to the ground surface or for raising it when not in use are also included. Such means can comprise a set of pivotal linkages operated by a lever adjacent the push/pull handle.

According to a particularly preferred embodiment, the apparatus may be supported on a self-propelled machine such as a golf buggy or similar machine. The apparatus may be associated with means enabling the height of the manifold, and therefore the plenum head, to be raised and lowered relative to the ground surface to obtain the optimum height for cleaning the synthetic grass surface. The means may include a set of pivotal linkages attached to the manifold operated by a lever adjacent the push/pull handle.

An arrangement may be provided for separating the fine particulate material and removing it. This arrangement may be as simple as a filter bag similar in operation to a vacuum filter bag. More complex or advanced systems may be provided depending upon requirements.

When a complex arrangement is provided for removing the separated fine particulate matter and collecting it, this will suitably comprise a cyclone and chamber in combination with a filtering system. The cyclone is conveniently connected directly by way of a flexible duct to the port of the manifold. One form of cyclone comprises a cylinder with a conical head piece which is oriented in a vertical location on the wheeled framework between the manifold and the push/pull handle. An inlet is provided in the sidewall of the cyclone at an intermediate position, and internal plates direct the entrained fine particulate matter around the inner wall towards the bottom of the cyclone to a collection chamber directly beneath it. A filtering system may be provided about an exhaust air outlet, or outlets, which is preferably located in the top of the cyclone. The filtering system may comprise one or more bags of filtering material supported from a framework which extends above the outlet(s). The filtering arrangement is designed to prevent any fine particulate matter blowing into the atmosphere while permitting the exhaust air to be expelled therethrough.

Compressed air used to charge the plenum chamber can be supplied from a portable compressor which is either carried by the support framework for the apparatus or is supplied by a separate remote compressor. In this later context, a single compressed air line preferably may supply air to an air line connected to the central inlet of the plenum arm member, and a take-off line for driving the equipment.

According to a particularly preferred embodiment, the compressed air may be supplied to the surface to be cleaned at a relatively low volume, (approximately 100 cubic feet per minute) but at a relatively high pressure (approximately 250 pounds per square inch). There may be an adjustment means provided to adjust the flow rate and/or pressure at which the compressed air is provided. For example, particularly high use areas of the surface, such as those about the service line on a tennis court, may require a more intensive cleaning than other, less well used areas. In this situation, a higher pressure flow at a lower flow rate may be used to clean the high use areas due to greater compaction of the surface at those areas while a lower pressure flow at a higher flow rate may be used at the lower use areas.

BRIEF DESCRIPTION OF THE DRAWINGS

Various embodiments of the invention will be described with reference to the following drawings, in which.

DETAILED DESCRIPTION OF A PREFERRED EMBODIMENT OF THE INVENTION

According to a preferred embodiment of the present invention, an apparatus for cleaning synthetic grass is provided.

Figure 1:
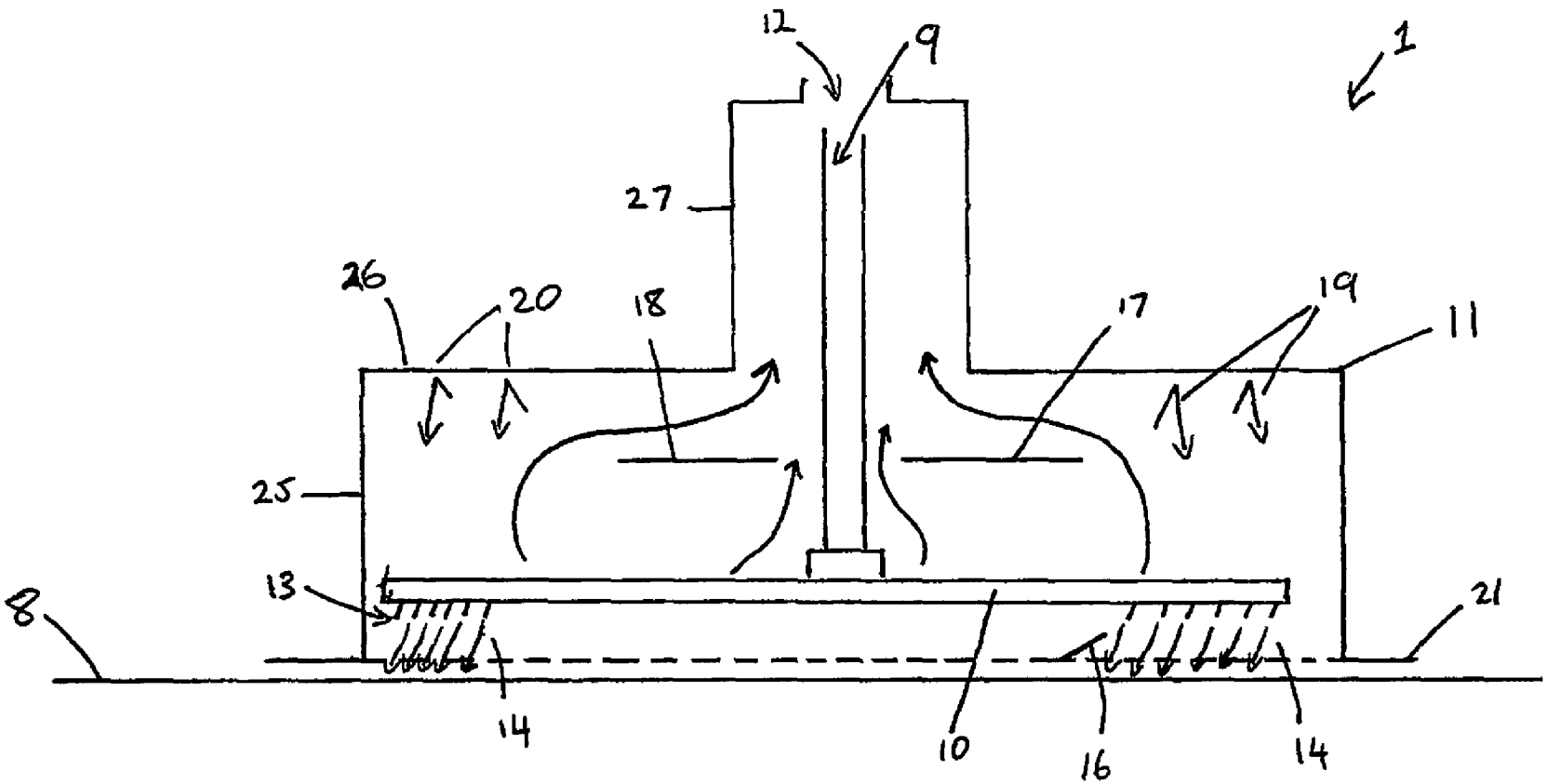
FIG. 1 is a cross-sectional view of an apparatus according to an aspect of the present invention.

Referring firstly to FIG. 1, the apparatus, indicated generally at 1, comprises a plenum chamber 10, a manifold 11 and a port 12.

In operation, compressed air is directed at high velocity against a wet compacted surface containing particulate matter. The particulate matter is uplifted and then dumped back onto the surface as the device is moved along, thereby producing a soft playing surface. This device is particularly suited to synthetic football, tennis and hockey fields which have a sand filling.

The plenum head 10 is a cylindrical tubular arm member which extends from one side of the device to the other in a transverse direction and has a compressed air inlet 9 located substantially at the centre of its length. The inlet is associated with a central mounting means. This central mounting allows the arm member to rotate about the inlet.

The plenum head includes a multiplicity of nozzle outlets 13 through which compressed air can be directed at an inclined angle against the particulate ground surface 8, in the direction of arrow 14. This action loosens the particulate matter so that it can be uplifted within the manifold and be entrained in a stream of air which lifts it through the manifold as shown by the arrows. Deflector plate 16 assists in directing the particulate matter in an upward direction.

Figure 2:
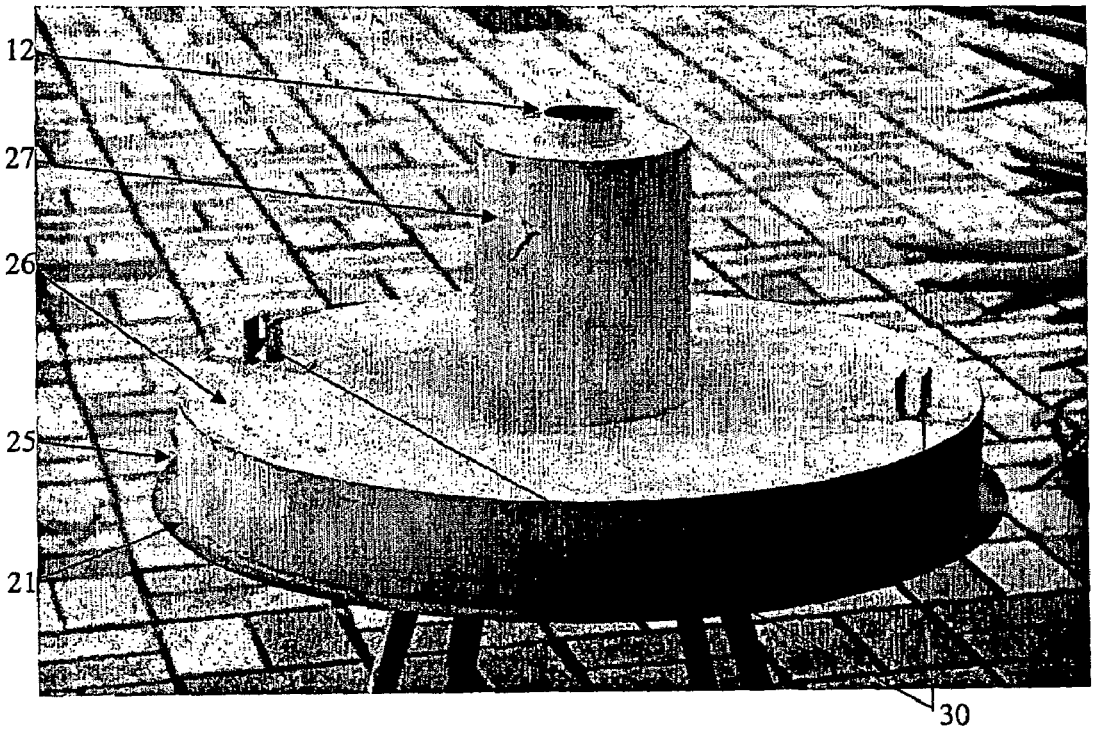
FIG. 2 is a perspective view of the manifold according to an aspect of the invention

The manifold, best illustrated in FIG. 2, is circular when viewed in plan and has a step or shoulder when viewed in elevation. The manifold has a lower sidewall 25 extending upwards away from the ground surface 8, an intermediate shoulder portion 26 extending substantially perpendicularly from the lower sidewall 25 and an upper sidewall 27 associated with the port 12 for the directed removal of the debris. The upper 27 and lower 25 sidewalls are substantially cylindrical and the shoulder portion 26 is a planar annular portion linking the two sidewalls. A lower opening is defined by the lower sidewall 25.

A lip 21 is provided at the perimeter of the manifold to prevent any particulate matter from being blown from the side of the manifold.

As the particulate matter is entrained upwardly, separation of the fine and coarse particles occurs due to their differences in momentum. The fine matter tends to be blown upwardly for exhaustion through port 12, while the heavier coarser matter tends to lag behind to a certain extent and be deflected by baffles 17, 18 and the shoulder portion 26 back on to the ground as shown by arrows 19, 20. The coarse particulate matter is, in fact laid back down in a similar array to that from which it was uplifted.

A typical air pressure employed with both aspects of the invention is 375 c.f.m at 110 psi, and the diameter of the pin holes is 1.5 mm. In use, the expulsion of the air from the plenum head will provide the rotational force to rotate the plenum head.

The apparatus will be supported on a self-propelled machine (not shown) such as a golf buggy or similar machine. The apparatus is associated with means enabling the height of the manifold, and therefore the plenum head, to be raised and lowered relative to the ground surface to obtain the optimum height for cleaning the synthetic grass surface. The raising and lowering means includes a set of pivotal linkages 30 attached to the manifold operated by a lever adjacent the push/pull handle.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

I claim:

1. An apparatus for cleaning a synthetic grass surface, the apparatus comprising a plenum head and a manifold, the plenum head disposed within the manifold and having a compressed air inlet and at least one air outlet through which air can be expelled against the synthetic grass surface for dislodgement of coarse and fine particulate material and to entrain the dislodged particulate material into the manifold which extends above said plenum head, said manifold including an outlet located in an upper region of the manifold for expelling the fine particulate material, and an outlet in a lower region of the manifold for distributing the coarse particulate material back to the synthetic grass surface, wherein the plenum head is mounted for rotation within the manifold about a substantially vertical axis.

2. The apparatus as claimed in claim 1, wherein said plenum head includes a plenum arm member of substantially tubular configuration and which extends from a first side of the apparatus to a second side of the manifold in a substantially horizontal disposition.

3. The apparatus as claimed in claim 2, wherein a plurality of outlets for compressed air are spaced along said plenum arm member.

4. The apparatus as claimed in claim 3, wherein the outlets in the plenum arm member are aligned at an angle of approximately 60° with respect to the synthetic grass surface.

5. The apparatus as claimed in claim 3, wherein the outlets in the plenum arm member are adjustable nozzles.

6. The apparatus as claimed in claim 1, wherein said manifold is a hollow cylindrical duct.

7. The apparatus as claimed in claim 6, wherein said manifold includes a lower sidewall extending upwards away from the ground surface, an intermediate shoulder portion extending substantially perpendicularly from the lower sidewall and an upper sidewall of smaller radius than the lower sidewall, and a port for the directed removal of the debris.

8. The apparatus as claimed in claim 7, wherein the upper and lower sidewalls are substantially cylindrical and the shoulder portion is a planar annular portion linking the two sidewalls.

9. The apparatus as claimed in claim 7, wherein the at least one outlet on the plenum head is located towards an outer end of the plenum head and the shoulder portion of the manifold extends inwardly from the lower sidewall a greater distance than the innermost outlet on the plenum head.

10. The apparatus as claimed in claim 1, which includes at least one baffle plate arranged to partially enshroud the manifold in order to prevent the second proportion of the dislodged particulate matter from being carried into the outlet located in the upper region and to direct the second proportion of the dislodged particulate matter to the outlet located in the lower region.

11. The apparatus as claimed in claim 1, which is supported on a wheeled framework.

12. The apparatus as claimed in claim 1 and including a compressed air source connected to said plenum head for supplying compressed air to the plenum head.

* * * * *